US006112552A

United States Patent [19]

Hoffman

[11] Patent Number: 6,112,552

[45] Date of Patent: Sep. 5, 2000

[54] GEMSTONE SETTING AND METHOD OF USING

[75] Inventor: Paul J. Hoffman, Huntington Beach, Calif.

[73] Assignee: Michael Anthony Jewelers, Inc., Mt Vernon, N.Y.

[21] Appl. No.: 09/229,085

[22] Filed: Jan. 12, 1999

[51] Int. Cl.[7] ..... A44C 17/02

[52] U.S. Cl. ..... 63/26; 63/27; 63/28; 63/29.1

[58] Field of Search ..... 63/26, 27, 28, 63/29.1

[56] References Cited

U.S. PATENT DOCUMENTS

| | | | |
|---|---|---|---|
| 664,725 | 12/1900 | Costigan | 63/28 |
| 1,192,092 | 7/1916 | Morse | 63/28 |
| 1,442,815 | 1/1923 | Marker et al. . | |
| 1,654,335 | 12/1927 | Lindroth . | |
| 1,958,946 | 5/1934 | Gautieri . | |
| 2,072,440 | 3/1937 | Bauer et al. . | |
| 2,141,363 | 12/1938 | Rigollet . | |
| 2,610,385 | 9/1952 | Manne . | |
| 2,749,597 | 6/1956 | Fus . | |
| 2,907,187 | 10/1959 | Karp et al. . | |
| 3,263,444 | 8/1966 | Di Croce . | |
| 3,339,378 | 9/1967 | Chirol . | |
| 4,648,248 | 3/1987 | Raymond | 63/28 |
| 4,738,240 | 4/1988 | Aich . | |
| 4,800,738 | 1/1989 | Bunz . | |
| 4,813,246 | 3/1989 | Richards . | |
| 4,835,987 | 6/1989 | Magnien et al. | 63/28 |
| 5,072,601 | 12/1991 | Slowinski . | |
| 5,115,649 | 5/1992 | Amber . | |
| 5,123,265 | 6/1992 | Ramot . | |
| 5,419,159 | 5/1995 | Muller . | |
| 5,437,167 | 8/1995 | Ambar . | |
| 5,488,839 | 2/1996 | Udko . | |
| 5,520,017 | 5/1996 | Vivat . | |
| 5,649,434 | 7/1997 | Itzkowitz . | |
| 5,690,477 | 11/1997 | Haimoff . | |
| 5,713,219 | 2/1998 | Itzkowitz . | |

FOREIGN PATENT DOCUMENTS

| | | | |
|---|---|---|---|
| 822 777 | 6/1937 | France . | |
| 826716 | 4/1938 | France | 63/28 |
| 833234 | 10/1938 | France | 63/28 |
| 835817 | of 1939 | France | 63/28 |
| 596 992 | 3/1932 | Germany . | |
| 513311 | 11/1936 | United Kingdom | 63/26 |
| 476471 | 12/1937 | United Kingdom | 63/28 |

*Primary Examiner*—Terry Lee Melius
*Assistant Examiner*—Andrea Chop
*Attorney, Agent, or Firm*—Helfgott & Karas, P.C.

[57] ABSTRACT

A gemstone setting is provided having channels into which grooved gemstones are snapped and secured. Each channel is provided with opposing, flexible prong members extending from the base of the gemstone setting. As the grooved gemstones are snapped into the channels, the prong members flex outwardly as the gemstones are pushed downwardly into the channels, such prong members snapping into engagement with the grooves on the gemstones to securely hold the gemstones within such channels. When the channels of the gemstone setting have been filled with gemstones, the gemstone setting is rendered invisible.

22 Claims, 3 Drawing Sheets

GEMSTONE SETTING AND METHOD OF USING

FIELD OF THE INVENTION

This invention relates to the setting of precious and semiprecious stones, applicable to all jewels, for the production of jewelry. In particular, the invention relates to a device for setting gemstones in a manner which conceals the setting, while firmly securing the stones in place.

BACKGROUND OF THE INVENTION

For many years, precious and non-precious gemstones have been mounted by crimping the gemstone between the prongs of a support structure, generally of metal, around and/or about the stone. Generally, the frame forming the setting, as well as the prongs of the support, remain visible when the jewel is viewed from above.

This manner of mounting may be suitable for stones of larger size, which are generally mounted as a single stone or with only a few stones. On the other hand, when it is desired to obtain a relatively large surface by placing smaller stones together, the visible metal parts create interruptions in the continuity of the surface. As a result, the visible metal parts detract from the aesthetic properties of the item and, therefore, are not always desirable.

To "invisibly" mount a large number of stones over a relatively large surface, the approach of the prior art has been to notch the diamonds and to mount them in a setting having two or more parallel walls, with metallic projections, e.g. prongs or the like, protruding from these walls for engaging notches in the gemstone. Typically, these walls define channels in which the stones are set, abutting one another in accordance with the known invisible mounting method.

Using the approach of the prior art, several problems and disadvantages arise. First, because of manufacturing variations in forming the notches and prongs to obtain a large matrix of stones, the fit between as least some of the stones and the walls may be imperfect. As a result, there may be too much play between the prongs and many of the stones and, therefore, a propensity of these loosely fitted stones to become dislodged. Therefore, there is a need in the jewelry industry for a variable gemstone setting which securely fixes stones of various and/or imperfect sizes within the setting without the risk of the stones becoming dislodged.

In addition, particularly in the case of a ring, a problem arises in that, in accordance with the teachings of the prior art, the walls which form the channels of the setting extend laterally, i.e. transversely to the major plane of the ring. Further, the metallic projections which are formed on the channel walls are fixed in place such that they do not exhibit a force upon and against the surface of the stones. As a result, when the wearer/manufacturer desires to adjust the size of the ring, particularly to downsize the ring to fit a thinner finger, decreasing the diameter of the ring has the effect of causing the lateral walls of the channels to move further apart. This loosens the inter-engagement between the metallic projections on the walls of the setting and the notches of the stones. As a result, previously well secured diamonds may fall out or become prone to be easily dislodged from the setting when the size of a ring is adjusted. Thus, rings designed using the teachings of the prior art can not readily be sized to fit the fingers of various users. Thus, a need exists in the marketplace for a gemstone setting which firmly locks gemstones in place such that, when used in conjunction with a ring, the ring may be effectively sized without loosing or dislodging the gemstones from within the gemstone.

Gemstone settings which include a plurality of gemstones, in which the setting is substantially invisible, are well known. For example Ramot (U.S. Pat. No. 5,123,265) discloses a gemstone assembly which includes a base formed with a plurality of ribs, defining at least one socket of rectangular configuration. Ribs of the setting are bent at their outer ends into grooves formed in the gemstone to fix the gemstone within the socket. However, Ramot does not disclose a slot cut within a bar of the setting, defining a flexible forward and rearward arm for securing gemstones in an invisible setting. Further, Ramot does not disclose a forward and rearward arm exerting a springing force upon the gemstone, thereby locking such stone firmly into the setting.

Another example is Muller (U.S. Pat. No. 5,419,159). Muller discloses an article of jewelry having a stone mounted on a support. The stone has two grooves formed on opposite sides of the stone to engage the support. The support is formed by a series of individual and separate bars, each bar having means for attachment to a neighboring bar. The attachment means permits pivoting of each bar with respect to the adjacent one. Each of the bars is dimensioned to receive stones along its length and each bar has a central recess of general V-shape which is open towards the top. However, Muller does not disclose a slot cut within the central bar along its length defining a flexible forward and rearward arm for securing a gemstone in an invisible gemstone setting. Further, in Muller the stones are not locked in place due to the pressurized springing force exerted by the forward and rearward arm upon the gemstone in the gemstone setting. Finally, Muller does not disclose a wire run through a hole along the entire length of the bar to increase the outward lateral force of the forward and rearward arm upon the gemstone, thereby clamping the stone within the setting.

Gem settings of widely varying structures, formed of more or less intricately shaped holding parts, are widely known in the jewelry industry. Setting stones within the structures generally requires substantial skill on the part of the jeweler, rendering the setting process both time consuming and expensive. This process becomes even more difficult and costly when fixing gemstones in "invisible" gemstone settings.

The conventional method of assembling a jewelry item with an invisible gemstone setting requires many difficult and intricate steps in order to place each individual gemstone correctly within the setting. These steps are repeated for all the rows or columns until the jewelry item is completed. This conventional method of invisibly setting gemstones to create jewelry items suffers from a number of disadvantages. First, casting of a jewelry item with a gemstone region including a recess and walls and preparing T-shaped cross bars is a relatively difficult and costly process. Such settings must be prepared in direct relation to the desired gemstone size such that any variation in size of the gemstone requires the casting of a corresponding setting. Further, slight inaccuracy or imperfection in the size of the gemstones will result in the inability to properly fix the gemstone within the specially designed setting. Thus, extra expense must be taken to insure precision and accuracy of both the pre-cut gemstones and the corresponding setting. Second, the assembly of the jewelry items requires considerable time of a skilled worker which adds greatly to the overall cost of the jewelry item. Lastly, the finished jewelry item cannot be readily downsized without disturbing the invisible gemstone setting.

Therefore, there is a need for a novel invisible gemstone setting which overcomes the disadvantages of the conventional prior art gemstone jewelry setting items. Furthermore, there is a need for a mass production technique of assembling jewelry items with invisible gemstone settings, so as to reduce the high cost of labor in the assembly of such jewelry items.

SUMMARY OF THE INVENTION

An object of the present invention is to provide a gemstone assembly having a substantially invisible setting in which the gemstone or gemstones are securely fixed within the setting.

It is a further object of this invention to provide a gemstone assembly which secures gemstones within a setting such that the assembly allows the wearer/manufacturer to downsize the ring to fit a thinner finger, decreasing the diameter of the ring, while still securing the stones firmly within the setting.

A further object of the present invention is to provide a gemstone assembly which secures gemstones within a setting having metallic projections and prongs engaging groves on the stones, whereby such metallic projections exert a force upon the wall of the gemstone, thereby firmly securing the gemstone within the setting when the metal or setting changes shape.

Finally, it is the object of the present invention to provide a gemstone assembly which allows for faster and more economical method for insertion of gemstones within a setting.

Other objects, features and advantages of the invention shall become apparent as the description thereof proceeds when considered in connection with the accompanying illustrative drawings.

DETAILED DESCRIPTION OF THE INVENTION

Figure 1:
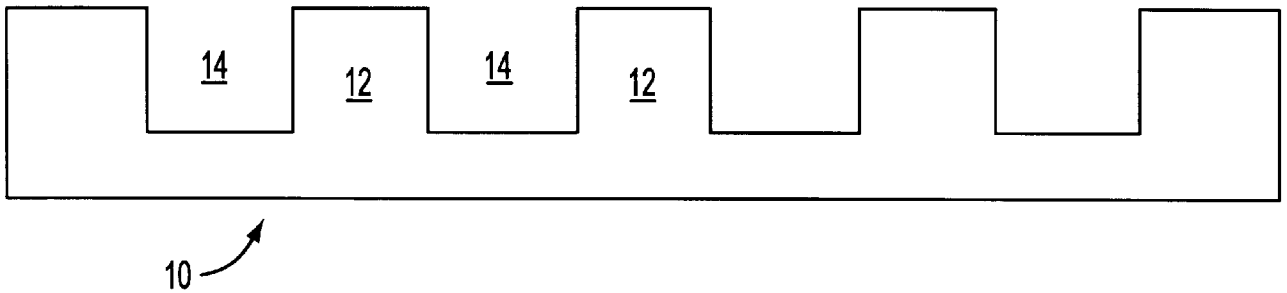
FIG. 1 is a side view of a plate, prior to cutting the slot and defining the forward and rearward arms.

In its simplest embodiment, the invention consists of a plate 10 having a plurality of bars 12 forming at least one channel 14 for securing a gemstone 16. The bar contains a hollow slot 19 through its center, thereby defining a forward arm 20 and rearward arm 22 about the hollow slot. Prongs 24 located on the forward and rearward arm 20 and 22 of the bars 12 engage grooves 26 formed through at least two opposed sides of the gemstone 16, thereby holding the gemstone within the setting. The hollow slot allows lateral movement of the forward and rearward arm, such that the gemstone may simply be snapped into the setting rather than secured by a skilled jeweler. Once snapped into place, the lateral movement of the forward and rearward arm exert a springing force upon the gemstone within the setting. In this way, the gemstone is secured firmly within the setting through both the prongs engaging the grooves within gemstone, coupled with the force exerted by the forward and rearward arm which tightly press the prongs in and upon the grooved sides of the gemstone. Further, the dual method of fastening the stone allows the gemstone setting to be used in conjunction with a ring which in turn may be downsized to fit a thinner finger by decreasing the overall diameter of the ring. As the diameter of the ring is adjusted, the springing force of the movable forward and rearward arms continue to exert pressure upon the gemstone as the ring is downsized, thereby firmly holding the gemstone securely within the gemstone setting during and after the sizing process.

In some embodiments, a continuous hole 28 may be placed through the length of the bar and a wire 30 inserted therethrough, subsequent to the setting of the gemstone in the present invention. The insertion of the wire increases the forward lateral springing force of the movable forward and rearward arms upon the gemstone, further clamping the gemstone more tightly in the gemstone setting.

Figure 5:
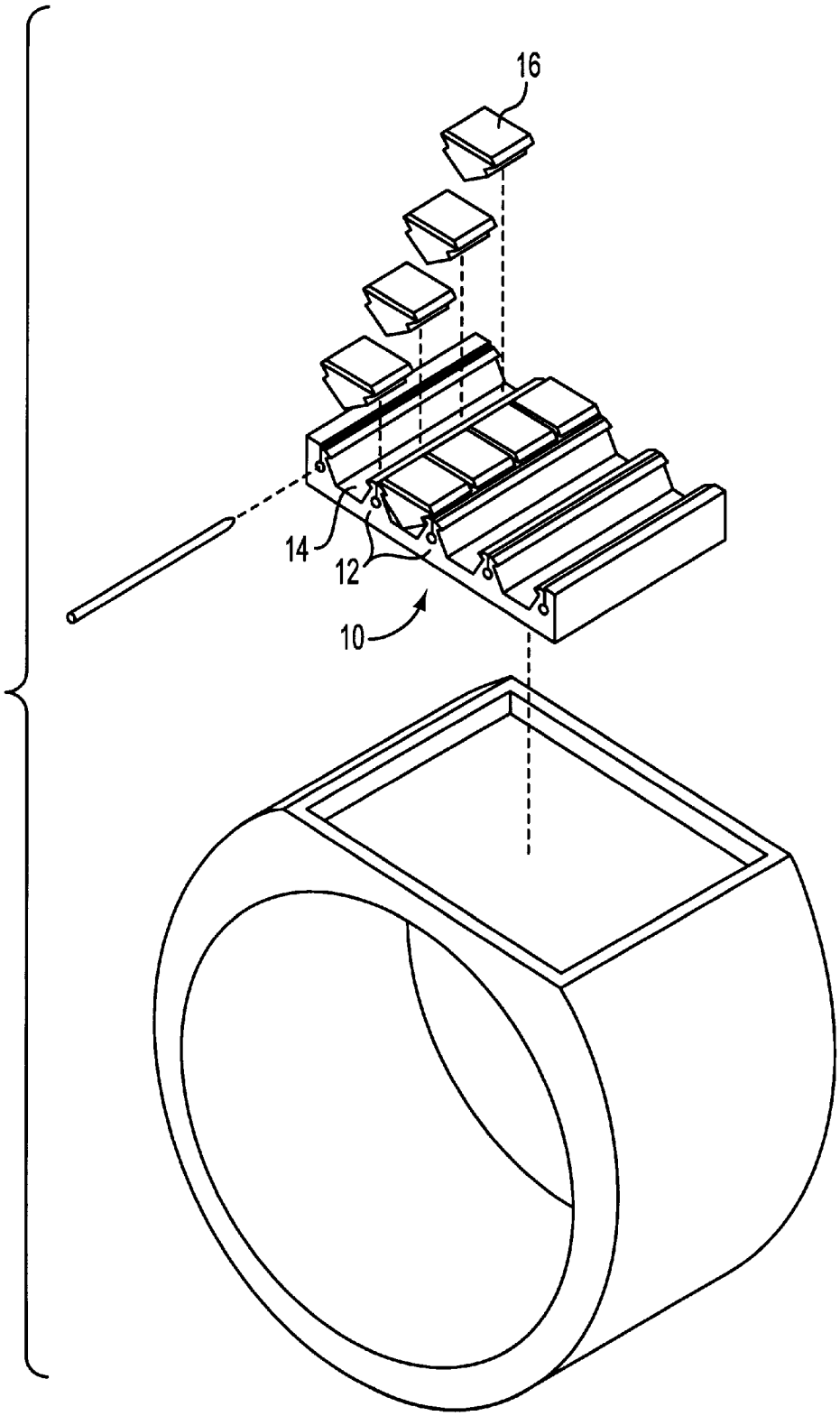
FIG. 5 is an exploded, perspective view of the invisible gen setting of this invention.

In the preferred embodiment, the invention consists of a plate 10 of varying size upon which a plurality of bars 12 are connected, forming at least one channel 14 for the securing of a gemstone 16. As seen in FIG. 5, the gemstone setting may be rectangular in shape with the bars 12 running along the length of the rectangular plate to form a plurality of channels 14. In alternate embodiments, the gemstone setting may consist of a variety of shapes and the bars may run along the width of the plate.

The gemstone setting may be made of any suitable metal such as gold, platinum, steel or silver.

Preferably, the gemstones to be used with the setting are of rectangular or square configuration and are pre-cut to correspond to the size of the channel. Further, each gemstone has an upper visible surface 50, a table 51 at the upper end thereof, a girdle 52 and an inverted pyramid-shaped pavilion 53 which defines four facets 54 which converge at the bottom of the gemstone. A groove 26 is formed through at least two opposed sides of the pavilion 53 just below the girdle 52.

The bars 12 have a top portion upon which at least one prong 24 is located. As shown, the preferred embodiment discloses a slot 18 located on either side of the top portion of the bars 12. Bars 12 located on the distal ends of the plate 10 may only contain one prong 24. The prongs 24 continue along the entire length of the bar. In addition, said prongs may be V-shaped so as to enhance the grip of the prong upon the stone. It is desired, but not mandatory, that the shape and size of the prong 24 correspond to the grooves formed in the gemstone.

A hollow slot 18 is cut through the center and along the entire length of each bar 12. The hollow slot 18 is perpendicular to the height of the bar and defines a forward arm 20 and a rearward arm 22 on either side of the hollow slot. Further, the forward and rearward arms are of the same size, shape and configuration. The slot allows the forward arm and rearward arm to move in a lateral direction perpendicular to the plate 10. At the distal ends of the plate the hollow slot cut into the bar defines a distal wall 40 and a single forward arm.

Figure 3:
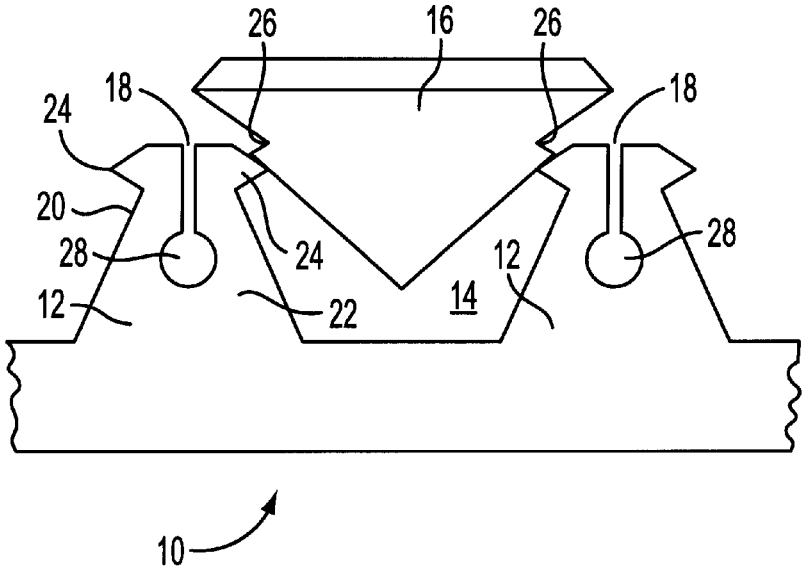
FIG. 3 is a side view of the plate, showing a stone just prior to being locked in the setting.
Figure 4:
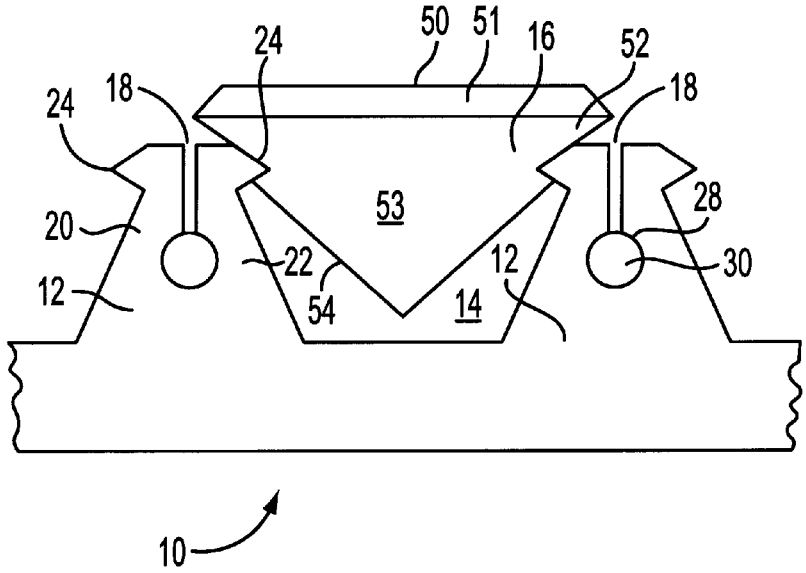
FIG. 4 is a side view of the plate, showing a stone locked into position in the setting.

Gemstones are placed in the gemstone setting by placing the pre-cut gemstone into the corresponding channels. As shown in FIG. 3, initially, the pavilion of the gemstone rests upon the prongs 24 located upon the forward arm 20 and rearward arm 22 of adjacent arms of the setting. When downward pressure is exerted upon the table of the stone, the hollow slot allows the forward arm and rearward arm to move slightly, thereby increasing the size of the channel. As the gemstone is pressed downward into the channel, the prongs align with the opposed grooves in the gemstone. When aligned (FIG. 4), the springing force of the forward arm 20 and rearward arm 22 force the prongs 24 to tightly engage into the grooves 26 of the gemstone. In this way, each individual gemstone may be simply snapped into the gemstone setting. In this regard, the simple procedure for setting gemstones provided by the current invention eliminates the difficult and intricate steps routinely involved with securing a variety of gemstones within a gemstone setting. Thus, the time to assemble the jewelry item is decreased and there is less need for expensive skilled labor to set the gemstones. Further, this procedure provides a technique of mass producing jewelry items both in a shorter period of time and at a decreased cost.

The springing force of the forward and rearward arms continues to exert pressure upon the stone once the gemstone is secured in its proper position within the setting. Thus, not only is the gemstone secured in the setting by the locking of the prongs in the corresponding grooves of the gemstone, but also by the continuing force exerting pressure upon the stone by the forward and rearward arm of the setting.

Figure 2:
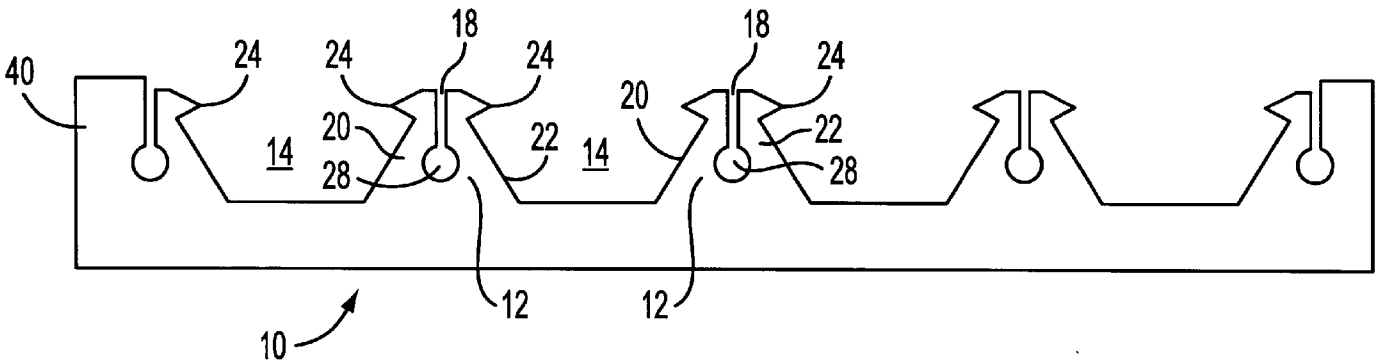
FIG. 2 is a side view of a plate, showing the slot and forward and rearward arms.

In another embodiment, a hole 28 may be placed through the entire length of the bar 12. FIG. 2 shows the preferred embodiment in which the hole 28 is located below the slot 18 and central to the cross section of the bar 12. However, the hole may be located anywhere along the height of the bar or the slot. Once the gemstone is secured within the channel of the gemstone setting, a wire 30 may be inserted through the entire length of the hole 28. The wire is manually run through the hole by placing a tapered end of the wire within the hole and then pulling the wire through the entire length of the hole, using a pulling means secured to the tapered end. Once inserted, the wire is cut flush with the edges of the plate, such that the wire is equal in length to the plurality of bars.

It is preferable, but not mandatory, that the diameter of the wire be larger then that of the hole. For example, in the preferred embodiment, the hole diameter is 0.45 mm and the wire diameter is 0.525 mm. In this way, the larger wire, once inserted within the hole, greatly increases the forward springing force of the forward and rearward arms away from the hollow slot in a lateral direction, creating strong tension and pressure upon the gemstone and securing the prongs tightly within the grooves of the gemstone. In effect, the gemstone is "clamped" into place. As a result, the gemstone is more securely fixed within the gemstone setting.

The gemstone setting of the current invention may be used in various jewelry items. In the preferred embodiment, it is used as an invisible gemstone setting placed within a ring (FIG. 5). Further, the gemstone setting of the current invention may be made as a separate setting from the ring and then inserted or fastened to the ring once the gemstones are secured within the gemstone setting. Alternatively, the gemstone setting may be incorporated within the ring as a unitary piece before the insertion of the stones. Moreover, the same setting can be used for pendants, brooches, earrings, or any jewelry piece with a setting for stones.

The springing force of the forward and rearward arms places a continuous pressure on the gemstone which will continue to hold the gemstones firmly and securely within the gemstone setting when the metal of the ring changes shape. This continuous pressure is greatly increased when the wire is placed through the hole in the bar. As the diameter of the ring decreases, the force of the arms continues to squeeze upon the pavilion of the stone, holding the prongs tightly within the grooves of the gemstone and securing the gemstone firmly within the channels of the invisible gemstone setting. In this way, a ring, incorporating the gemstone setting of the current invention, may be sized to fit a thinner finger by decreasing the diameter of the ring without the risk that the stones will become loose or dislodged upon changing the shape and/or size of the ring. Thus, jewelers, currently selling rings in the marketplace incorporating invisible gemstone settings, may stock less rings and size them accordingly to the needs of the purchaser, thereby decreasing overhead costs.

In experimental testing, the range of sizing capable using the current invention, while still firmly holding the gemstones in place, was from a size 7 to a size 4¾. In effect, a range of 2¼ sizes was achieved, while still securing the gemstones within in the current invention, due to the continuous pressure exerted by the arms upon the gemstone.

Further, the springing force and flexibility of the forward and rearward arms utilized in the current invention create the versatility to vary the size of the gemstone up to 0.2 mm while still being able to firmly secure the gemstones within the gemstone setting. Thus, extra expense need not be taken to insure exact precision and accuracy of both the pre-cut gemstone and the corresponding setting. In addition, various sizes of stones available may be incorporated in a single setting.

Variation of the pre-cut grooves within the gemstone can more firmly lock the gemstone into place and avoid slippage of the gemstone upon sizing. The groove within the gemstone is generally V-shaped and corresponds to the shape and size of the prongs. In the preferred embodiment, the bottom portion of the groove is angled such that it is perpendicular to the table and/or the plate of the gemstone setting. As a result, when the gemstone setting is flexed and/or bent during the sizing of the ring, the prongs located upon the bars more effectively interlock with the grooves of the gemstone. In this way, the prongs more securely fix the gemstone within the gemstone setting.

In the alternative, the current invention may be employed in other items designed to be worn by a user, for example, a bracelet, a necklace, a wristwatch and the like. Still again, the current invention may be employed in a jewelry item fashioned as any one of a wide range of personal or household items, for example, a cigarette case, a vanity box and the like.

The invention is described in detail with reference to a particular embodiment, but it should be understood that various other modifications can be effected and still be within the spirit and scope of the invention.

I claim:

1. A gemstone setting for securing gemstones of various sizes and having grooves formed along at least two opposed sides, said gemstone setting comprising:

a) a plate having a base, b) a plurality of bars integral with, successively arranged and extending upwardly from said plate, each bar having an upper terminus and a slot extending downwardly from such upper terminus and terminating in a hole, c) at least one channel defined between a pair of successively arranged bars for the positioning of gemstones within, d) at least one bar of said plurality further comprising at least one flexible prong extendable into said at least one channel and adapted for compressive engagement with at least one groove on one side of one said gemstones, another successively arranged bar of said plurality further comprising two flexible prongs, one of said two prongs extendable into said at least one channel such that said at least one channel is bound by opposing prongs from said one and another successively arranged bars of said plurality, e) said hole and said slot enabling said opposing prongs to flex outwardly from said channel in response to a gemstone being snapped therein, and to flex inwardly into compressive engagement with said grooves of said gemstone when said gemstone is snapped into said at least one channel.

2. A gemstone setting in accordance with claim 1, wherein a compressive force member independent of said flexible prongs is provided for increasing the compressive engagement of said prongs with said grooves for further securing of said gemstone into said channel.

3. A gemstone setting in accordance with claim 2, wherein said compressive force member comprises a wire insertable into said hole, said hole having a diameter and said wire having a diameter larger than the diameter of the hole and adapted for widening the slot extending from said hole and thereby enhancing the compressive engagement of said prongs with gemstones.

4. A gemstone setting in accordance with claim 1 wherein the base of the plate is continuous.

5. A gemstone setting in accordance with claim 1 wherein the plurality of bars extending upwardly from said plate are continuous with said plate and fixed thereto.

6. A gemstone setting in accordance with claim 1 wherein the setting is adapted to be rendered invisible upon the snapping of gemstones thereon.

7. A gemstone setting in accordance with claim 1 wherein said setting is adapted to receive gemstones varying by approximately 0.2 mm within said setting.

8. A gemstone setting in accordance with claim 1 wherein the size and shape of said prongs are adapted to correspond to grooves of gemstones snapped into said setting.

9. A method of using a gemstone setting for securing grooved gemstones of various sizes thereon, such gemstones each having a visible upper surface, a body extending in a direction opposite the visible upper surface and a groove along opposite sides of the gemstone body, comprising the steps of:

a) providing a gemstone setting, said gemstone setting comprising:

i. a plate, ii. a plurality of successively arranged bars extending upwardly from said plate, each bar having an upper terminus and a slot extending downwardly from such upper terminus and terminating in a hole, iii. at least one channel defined between successive bars for the positioning of gemstones within, iv. at least one bar of said plurality further comprising at least one flexible prong extendable onto said st least one channel and adapted for compressive engagement with at least one groove on one side of one of said gemstones, another successively arranged bar of said plurality further comprising two flexible prongs, one of said two prongs extendable into said at least one channel such that said at least one channel is bound by opposing prongs from said one and another successively arranged bars of said plurality, b) positioning the body of a first gemstone into said at least one channel and onto said opposing prongs, c) snapping said gemstone into said at least one channel by pressing downwardly on said visible surface of said gemstone, which causes said opposing prongs to flex outwardly from said channel and then to flex inwardly into compressive engagement with said grooves of said gemstone, d) snapping successive gemstones into further channels defined between remaining successive bars, said further channels being bound by opposing prongs, until said gemstones fill said further channels of said setting, rendering said gemstones setting invisible.

10. A method of using a gemstone setting in accordance with claim 9 further comprising the step of increasing the compressive engagement of said prongs with said grooves of said gemstones once said gemstones have been snapped into said channels.

11. A method of using a gemstone setting in accordance with claim 9 said hole having a diameter, said method further comprising the step of inserting a wire section having a diameter larger than that of said hole into said hole to enhance the compressive engagement of said prongs with said grooves of said gemstones.

12. A method of using a gemstone setting in accordance with claim 9 further comprising the step of fastening said gemstone setting to an item of jewelry.

13. A method of using a gemstone setting in accordance with claim 9 wherein said gemstone setting is incorporated into an item of jewelry as a unitary piece prior to insertion of the gemstones into said channels.

14. A jewelry item comprising:

a) a plurality of gemstones having grooves formed along at least two opposed sides, and b) a gemstone setting for securing said plurality of gemstones comprising:

i. a plate having a base, ii. a plurality of bars integral with, successively arranged and extending upwardly from said plate, each bar having an upper terminus and a slot extending downwardly from such upper terminus and terminating in a hole, iii. at least one channel defined between a pair of successively arranged bars for the positioning of said gemstones within, iv. at least one bar of said plurality further comprising st least one flexible prong extendable into said at least one channel and adapted for compressive engagement with at least one groove in one side of one of said gemstones, another successively arranged bar of said plurality further comprising two flexible prongs, one of said two prongs extendable onto said at least one channel such that said at least one channel is bound by opposing prongs from said one and another successively arranged bars of said plurality, v. said hole and said slot enabling said opposing prongs to flex outwardly from said channel in response to a gemstone being snapped therein, and to flex inwardly into compressive engagement with said grooves of said gemstone when said gemstone is snapped into said at least one channel.

15. A jewelry item in accordance with claim 14, wherein a compressive force member independent of said flexible prongs is provided for increasing the compressive engagement of said prongs with said grooves for further securing of said gemstone into said channel.

16. A jewelry item in accordance with claim 15, wherein said compressive force member comprises an expansion member insertable into said hole, said hole having a diameter and said expansion member having a diameter larger than the diameter of the hole.

17. A jewelry item in accordance with claim 14, wherein the base of the plate is continuous.

18. A jewelry item in accordance with claim 14, wherein the plurality of bars extending upwardly from said plate are continuous with said plate and fixed thereto.

19. A jewelry item in accordance with claim 14, wherein said gemstone setting is adapted to receive gemstones varying by approximately 0.2 mm within said setting.

20. A jewelry item in accordance with claim 14, wherein the size and shape of said prongs are adapted to correspond to the grooves in said gemstones.

21. A jewelry item in accordance with claim 14, wherein said gemstone setting is attachable to a jewelry article.

22. A jewelry item in accordance with claim 14, wherein said gemstone setting is integral with a jewelry article.

* * * * *